US005491373A

United States Patent [19]

Cooper et al.

[11] Patent Number: 5,491,373

[45] Date of Patent: Feb. 13, 1996

[54] COMMUTATORS

[75] Inventors: David L. Cooper, Buies Creek; Robert C. Dunigan, Benson; Joseph M. Grenier; Eric G. Lee, Dunn, all of N.C.

[73] Assignee: The Morgan Crucible Company plc, Windsor, England

[21] Appl. No.: 302,117

[22] Filed: Sep. 7, 1994

[51] Int. Cl.[6] ..... H01R 39/16; H01R 39/52

[52] U.S. Cl. ..... 310/235; 310/233; 310/234; 310/236

[58] Field of Search ..... 310/233, 234, 310/235, 236, 237; 29/597; 200/DIG. 6, DIG. 7

[56] References Cited

U.S. PATENT DOCUMENTS

| | | | |
|---|---|---|---|
| 1,736,988 | 11/1929 | Tupper . | |
| 2,535,824 | 12/1950 | Wahlberg . | |
| 2,953,698 | 9/1960 | Gianotto . | |
| 3,079,520 | 2/1963 | Schafer et al. . | |
| 3,450,914 | 7/1969 | Demerciere . | |
| 3,457,446 | 7/1969 | Akunts et al. . | |
| 4,056,882 | 11/1977 | Letts . | |
| 4,439,913 | 4/1984 | Coquillart . | |
| 4,481,439 | 11/1984 | Stokes . | |
| 4,559,464 | 12/1985 | Stokes . | |
| 4,663,834 | 5/1987 | Stokes . | |
| 4,786,835 | 11/1988 | Bode et al. | 310/233 |
| 4,868,440 | 9/1989 | Gerlach et al. . | |
| 5,008,577 | 4/1991 | Wang | 310/233 |
| 5,124,609 | 6/1992 | Nagasaka | 310/233 |

FOREIGN PATENT DOCUMENTS

| | | |
|---|---|---|
| 250493 | 11/1966 | Austria . |
| 674358 | 4/1939 | Germany . |
| 3-112340 | 5/1991 | Japan . |
| 468616 | 7/1937 | United Kingdom . |

*Primary Examiner*—R. Skudy

*Attorney, Agent, or Firm*—Dean W. Russell; Kilpatrick & Cody

[57] ABSTRACT

An improved commutator anchoring system and methods of manufacturing such a system are disclosed. The system includes a wound fiberglass or other ring embedded in the internal core of the commutator to reinforce the resulting structure and enhance its thermal and mechanical stability. The reinforcing ring also functions as a form about which various anchors can be patterned, increasing their uniformity over free-form designs.

10 Claims, 9 Drawing Sheets

COMMUTATORS

This invention relates to rotary switches and more particularly to commutators used in connection with electric motors.

BACKGROUND OF THE INVENTION

Many existing commutators, high-speed rotary switches typically used with electric motors, comprise multiple copper segments arranged into a cylinder and anchored into a non-conducting (often phenolic) molding compound. Each segment is physically separated and electrically isolated from those adjacent to it, so that an electrical brush passing along the outer diameter of the cylinder will form a conductive path only with the segment (or segments) in contact with it at any given instant. With one electrical brush, therefore, for each rotation of the cylindrical commutator the number of possible state changes is equal to twice the number of its copper segments.

These existing commutators are formed in various manners. One such method, producing a "built-up" product, requires formation of each conducting segment individually. The individual segments are then arranged circularly in a frame. After the segments are properly placed, a molding compound is inserted into the central area of the frame in contact with the inner surfaces of each segment.

Another formation method produces a cylindrical shell by curling a flat copper strip. As with the "built-up" method, molding compound is then inserted into the center of the cylindrical structure to create the core of the finished product. Thereafter the individual conducting segments are formed by cutting, or slotting, periodically through the copper cylinder. The widths of these slots space each segment from those adjacent to it, providing the electrical isolation necessary for proper operation of the commutator. Although less expensive to manufacture, existing shell commutators are often less durable than their "built-up" counterparts.

Both shell and "built-up" commutators operate at high speeds, approaching, in some cases, many thousands of revolutions per minute. As a result, the conducting segments are subjected to substantial centrifugal and thermal forces, tending ultimately to disengage the segments from the central core and thereby cause the commutators to fail. Currently-existing manufacturing processes, therefore, can be manipulated to form interior features for the segments which act to anchor the segments into the molded core. Features presently in use by various manufacturers resemble, for example, dovetail-shaped recesses, acute angular protrusions, and hooks. The hooks and acute angular protrusions are created, usually in pairs, by free-form paring the interior surfaces of the segments.

The molding compound is also exposed to the centrifugal and thermal forces during operation, which in some cases can reduce the useful life of the commutator by destroying the integrity of the molding compound itself. This potential problem can be particularly acute if the integrity of the compound is disturbed near the anchors of any particular segment. As a result, a need exists to reinforce the compound and remainder of the commutator and protect against these adverse consequences.

SUMMARY OF THE INVENTION

The present invention provides an improved shell commutator anchoring system including an internal reinforcing ring embedded in the commutator's molded core. In some embodiments the ring of this anchoring system is placed at or near the commutator's center of mass. The reinforcing ring also functions as a form about which the (nominally upper) hook or anchor of each conducting segment is patterned, permitting more uniform formation of each such anchor while holding it in place when subjected to centrifugal and thermal forces.

The wound fiberglass strands or other material from which the rings preferably are formed additionally have greater structural integrity than their associated molded cores, reducing the possibility of core degradation adjacent (at least) the upper portion of the anchoring system. The invention is particularly useful for enhancing the durability, performance, and thermal stability of shell-type commutators while minimizing the concomitant increase in the cost of such products. It can, however, be employed in connection with other segment designs and manufacturing techniques.

To form shell commutators according to the present invention, the flat conductor is replaced with one having a step or ledge along its (interior) length. Curling the material into a cylinder causes the ledge to assume a circular shape along the cylinder's inner circumference, forming a support onto which the reinforcing ring is placed. The strip is subsequently pared to form the nominally upper anchoring hooks about the ring. Together with the ledge, these upper hooks retain the ring in position during the remainder of the manufacturing process. Additional paring forms (nominally lower) hooks and other anchors. A phenolic or other molding compound is then inserted, filling the areas within the cylinder and around the anchors, and cured to fix the mechanical properties of the resulting device. Thereafter the individual conducting segments are formed by cutting periodically through the cylinder.

If desired, suitable equipment can also be used to form tangs in the upper section of the device by removing conducting material from the conducting strip, typically before it is curled, and these tangs formed into external hooks. Wire brushing or other appropriate techniques can remove oxidation from the commutator segments and conducting residue from the slots as necessary, and existing testing techniques utilized to evaluate the electrical properties of the commutator. Producing "built-up" commutators according to the present invention would proceed similarly, although, as noted above, the individual segments would continue to be formed prior to their being arranged into a cylindrical shape.

It is therefore an object of the present invention to provide an improved anchoring system primarily for shell-type commutators.

It is another object of the present invention to provide a reinforcing ring of greater structural integrity than the core material into which the anchors are embedded.

It is a further object of the present invention to provide an anchoring system in which the ring functions as a form about which portions of the system are patterned.

It is an additional object of the present invention to provide an anchoring system designed in some embodiments to position the reinforcing ring near the commutator's center of mass.

It is yet another object of the present invention to provide a commutator segment having an internal ledge on which the ring is supported both during the manufacturing process and in use.

It is also an object of the present invention to provide a shell-type commutator with enhanced durability, performance, and thermal stability.

Other objects, features, and advantages of the present invention will become apparent with reference to the remainder of the text and the drawings of this application.

DETAILED DESCRIPTION

Figure 1:
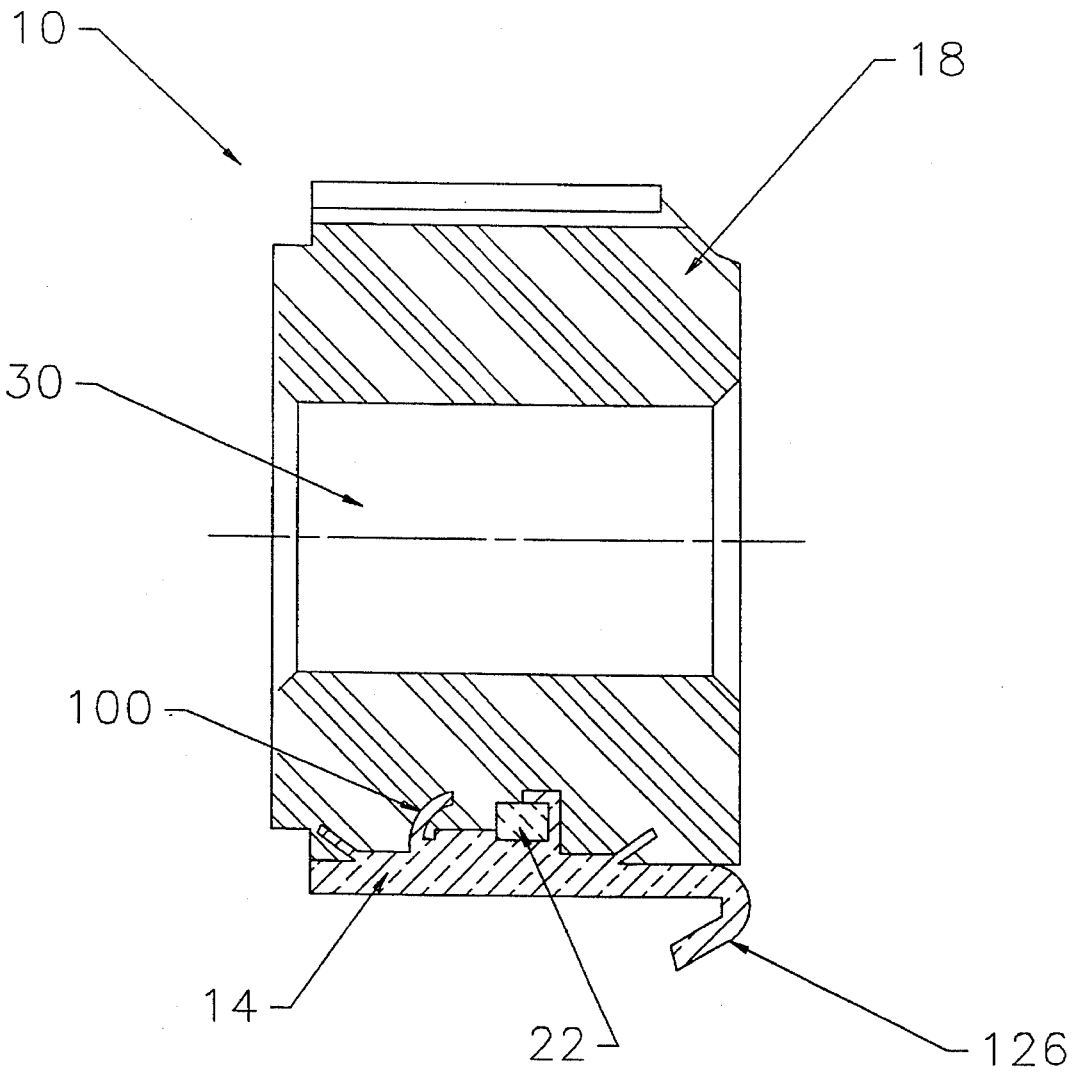
FIG. 1 is a cross-sectional view of a commutator of the present invention.
Figure 2:
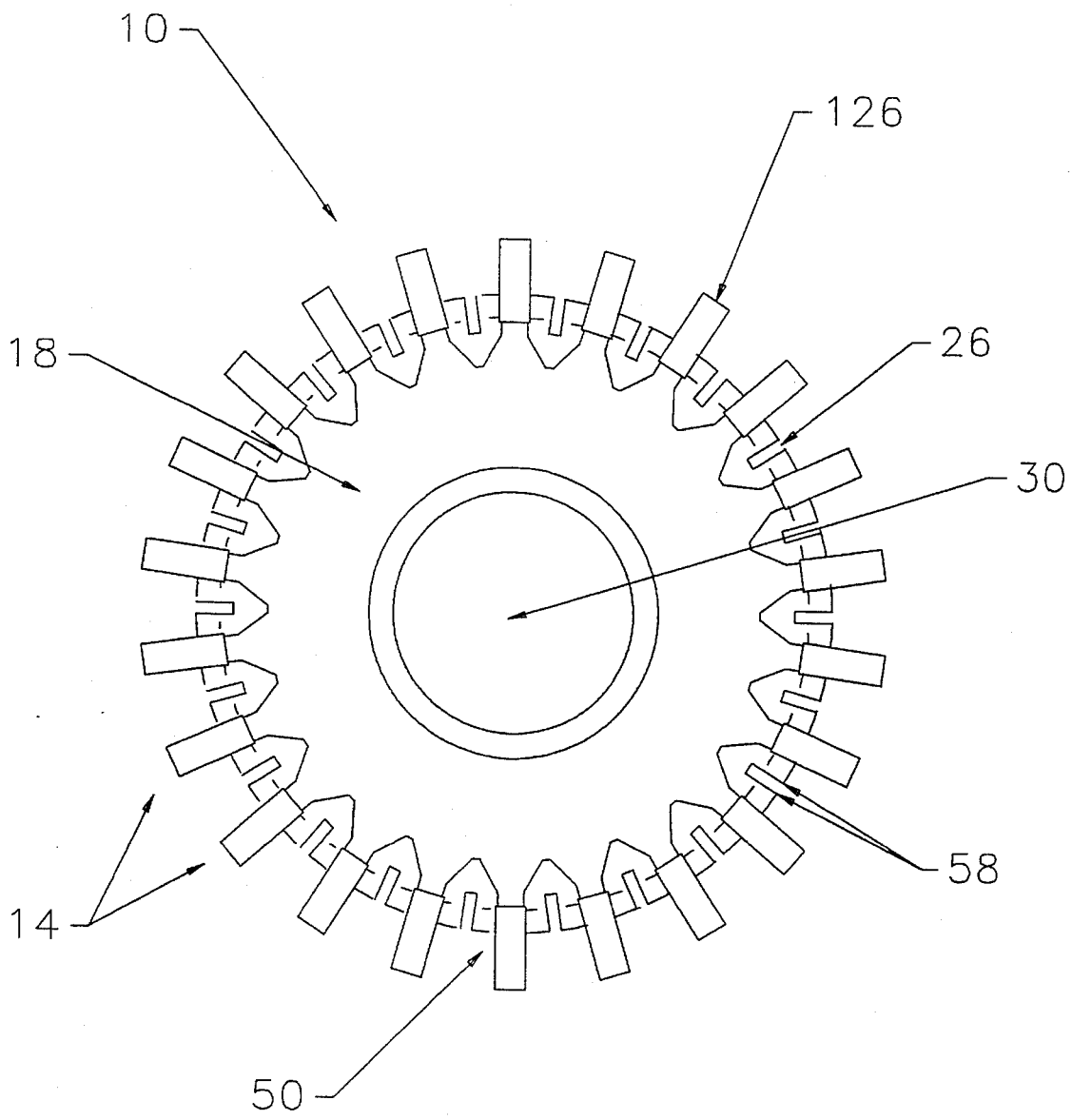
FIG. 2 is a top plan view of the commutator of FIG. 1.

FIGS. 1–2 illustrate (shell) commutator 10 of the present invention. Commutator 10 includes multiple electrically-conductive bars 14, typically copper, anchored in a phenolic (or other suitable) core 18. Additionally embedded in core 18 is ring 22, which functions to reinforce core 18 and enhance the thermal and mechanical stability of commutator 10. Ring 22 is preferably formed of fiberglass strands with epoxy resin, although other non-conductive materials may be used as necessary or desired.

Intermediate adjacent bars 14 are gaps or slots 26, which isolate the adjacent bars 14 electrically and permit commutator 10 to operate as a high-speed rotary switch. As shown in FIG. 2, some embodiments of commutator 10 contemplate use of twenty-two bars 14, permitting as many as forty-four state changes to occur for each rotation of the commutator 10. Core 18 further defines a central aperture 30 for receiving a spindle in use. Together, bars 14 and ring 22 contribute to form a commutator 10 more thermally stable at high speeds and temperatures than existing shell-type products and less expensive and complex than conventional "built-up" devices.

Figure 3:
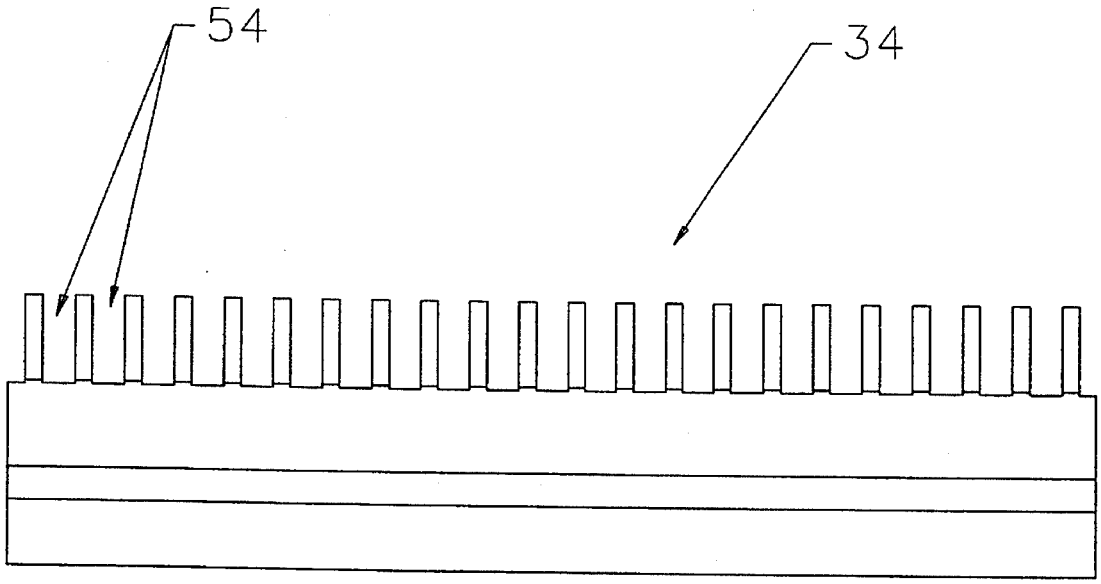
FIG. 3 is a plan view of a blank from which the commutator of FIG. 1 may be formed.
Figure 4:
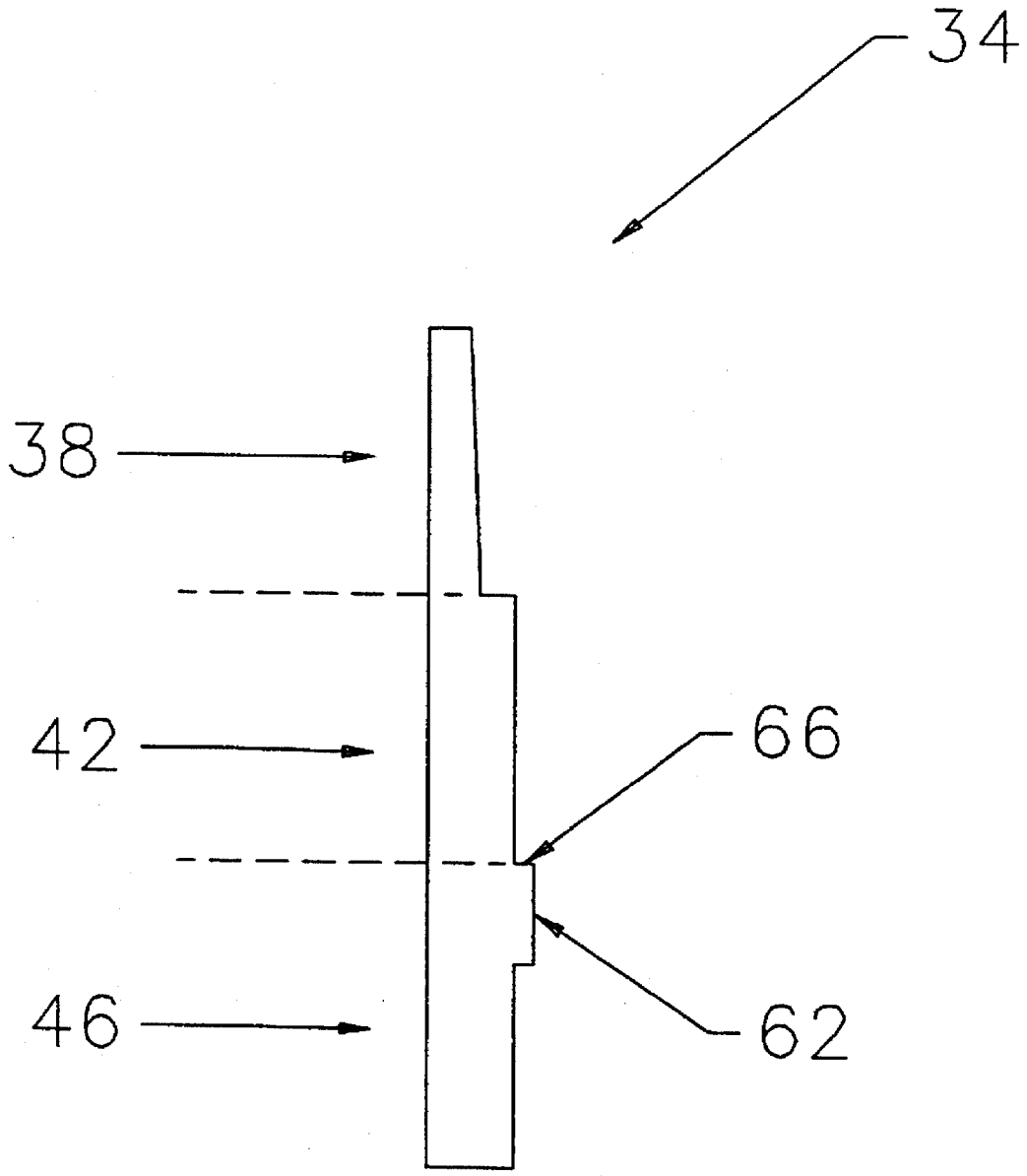
FIG. 4 is a side view of the blank of FIG. 3.

Detailed in FIGS. 3–4 is blank 34 from which commutator 10 is formed. Unlike "built-up" commutators, commutator 10 is not manufactured using individual conductive segments, but instead created from a continuous metal strip such as the blank 34 shown principally in FIG. 3. Divided into nominally upper, middle, and lower sections 38, 42, and 46, respectively (FIG. 4), blank 34 is curled to form the cylindrical exterior 50 of commutator 10. Beforehand, however, blank 34 is die-cut or otherwise acted upon to remove material from areas 54, spacing the discrete upper sections (tangs) 38 and forming shoulders 58 of what ultimately become adjacent bars 14.

FIG. 4 illustrates the varying thickness of blank 34. Lower section 46, for example, includes region 62 of increased thickness, forming step or ledge 66 at its boundary with middle section 42. Ledge 66 constitutes a significant feature of commutator 10, supplying, when blank 34 is curled, an interior support upon which ring 22 may be placed. The designs of most existing shell commutators, by contrast, cannot incorporate features such as ledge 66 and ring 22, precluded by either the anchoring geometry employed or the sequence in which the anchors are made.

Figure 5A:
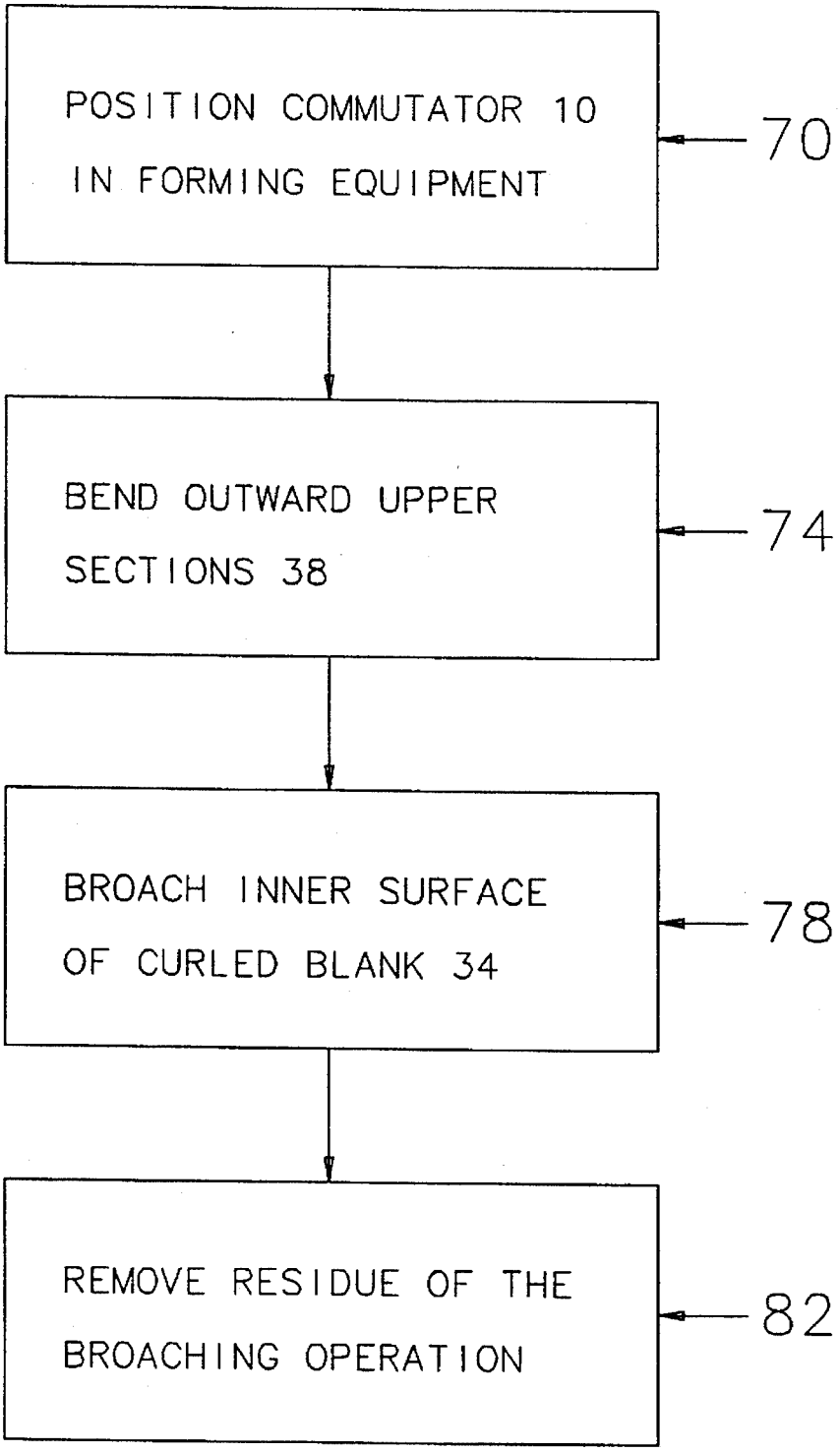
FIG. 5A is a flow chart presenting various steps in the formation of the commutator of FIG. 1.

FIG. 5A provides a flow chart presenting some of the operations employed in forming commutator 10. After being positioned in the cavity of appropriate forming equipment (block 70), upper sections 38 of curled blank 34 may be bent or spread outward (block 74) to reduce the risk of their becoming entangled with any paring tools. The inner surface of curled blank 34 may then be broached as desired (block 78) to facilitate anchor formation and later slotting of commutator 10 and any residue of the broaching operation removed (block 82).

Figure 5B:
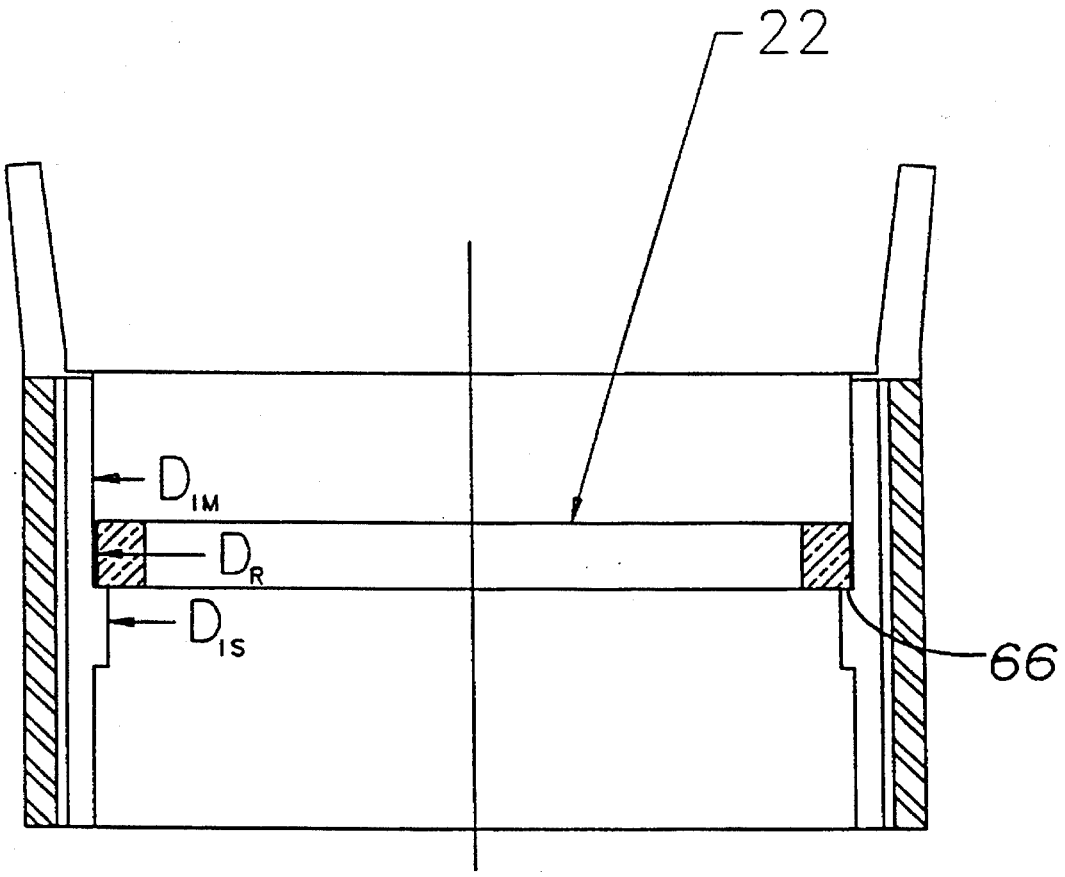
FIGS. 5B–D are cross-sectional views of the commutator of FIG. 1 at various stages of its formation.
Figure 5C:
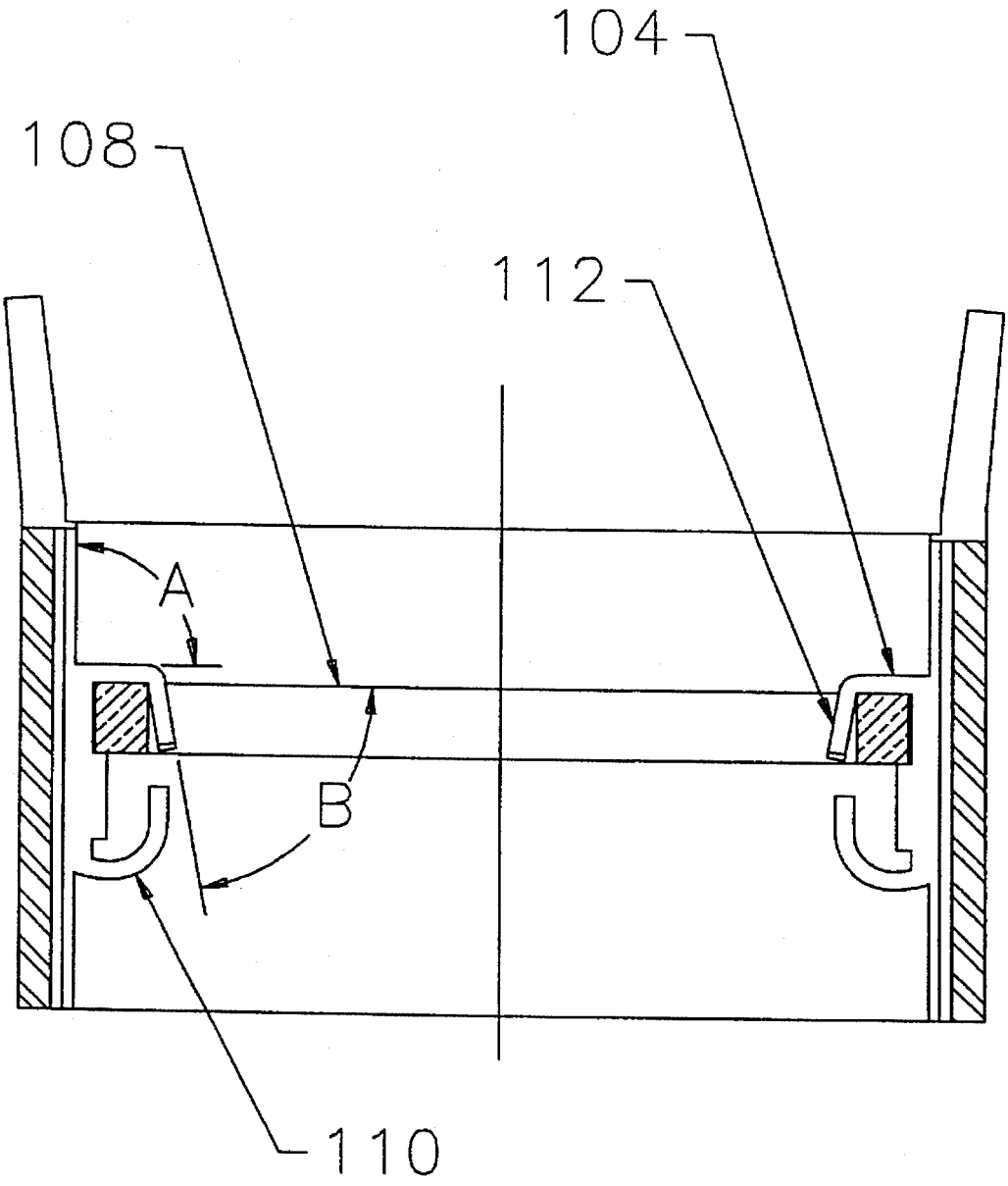
Figure 5D:
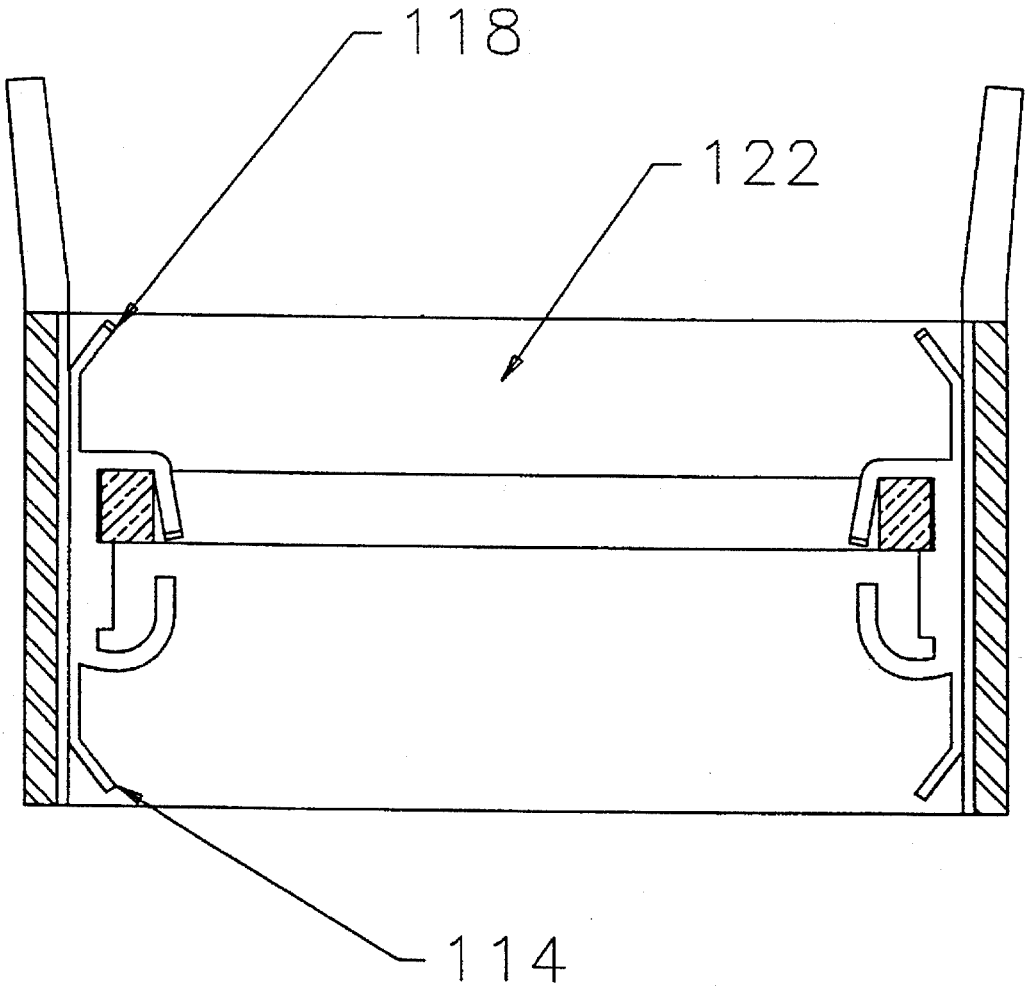

FIGS. 5B–D detail creation of internal anchoring system 100 of commutator 10. Initially, with curled blank 34 upright, ring 22 is positioned on ledge 66 as shown in FIG. 5B. Ring 22 has a diameter $D_R$ slightly less than the inner diameter $D_{IM}$ of curled blank 34 measured at middle section 42, ensuring a relatively secure fitting of the ring 22 within blank 34. Diameter $D_R$ is, of course, greater than the inner diameter $D_{IS}$ of curled blank 34 measured at region 62, however, permitting it to rest on ledge 66.

Paring middle section 42 creates upper anchor 104 (FIG. 5C), which may then be bent flush with the upper surface 108 of ring 22 at an angle A approximately 90° to the remainder of blank 34. Concurrently, lower section 46 is pared to commence forming lower anchor 110. Tip 112 of upper anchor 104 thereafter is deflected about ring 22 at an angle B slightly less than (or approximately equal to) 90°. Doing so traps ring 22 between ledge 66 and upper anchor 104, mechanically fastening curled blank 34 to ring 22 and retaining ring 22 in place during the remainder of the manufacturing process and while commutator 10 is in use. By utilizing ring 22 as a form about which upper anchor 104 is bent, moreover, the shape of the upper anchor 104 may be made more uniform from commutator to commutator than in existing free-form designs.

As shown in FIG. 5C, curling of lower anchor 110 may occur at this time as well. Additional paring of lower and middle sections 46 and 42 (as in FIG. 5D) produces lower and upper crowns 114 and 118, respectively, completing creation of the internal anchoring system 100 of commutator 10. Core 18 may thereafter be formed by injecting material from above curled blank 34 into the interior space 122 defined by it and curing the material, effectively embedding internal anchoring system 100 within. Because the structural integrity of ring 22 is greater than that of the material of core 18, however, the close fit between upper anchor 104 and ring 22 strengthens and stabilizes the resulting commutator 10 by precluding (or at least minimizing) the material of core 18 from being injected between them. In some embodiments of commutator 10, the placement of ring 22 and geometry of internal anchoring system 100 may also be designed to position ring 22 at or adjacent the center of mass of commutator 10.

Slots 26 typically are then machined, concurrently forming and electrically isolating adjacent bars 14 of commutator 10. Although not shown in FIGS. 5A–D, bars 14 additionally may be cleaned and brushed if desired and the discrete tangs or upper sections 38 of blank 34 bent into hooks 126. Central aperture 30 of core 18 may also be machined to an appropriate diameter.

Figure 6:
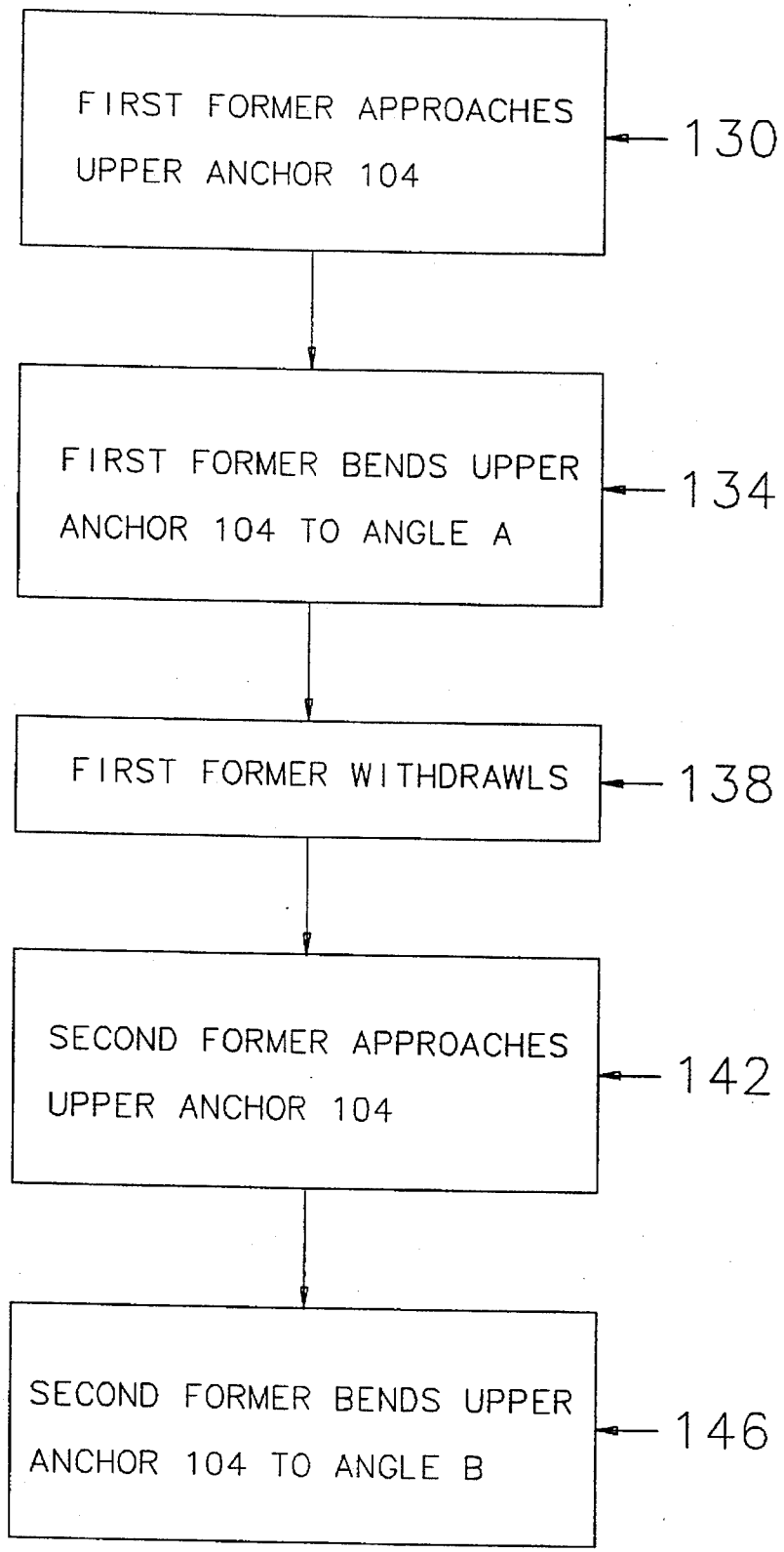
FIG. 6 is a flow chart detailing additional steps in the formation of the commutator of FIG. 1.

FIG. 6 further details manipulation of upper anchor 104 about ring 22. After being pared, upper anchor 104 is approached by a first former (block 130) having a diameter approximately equal to $D_R$. The first former continues its downward travel, contacting upper anchor 104 and bending the upper anchor 104 to form the angle A shown in FIG. 5C (block 134). The first former then withdraws (block 138), permitting a second former to approach and contact upper anchor 104 (block 142). The second former in turn continues its downward travel, forcing tip 112 about ring 22 (block 146) to form angle B illustrated in FIG. 5C.

The foregoing is provided for purposes of illustrating, explaining, and describing embodiments of the present invention. Modifications and adaptations to these embodiments will be apparent to those skilled in the art and may be made without departing from the scope or spirit of the invention.

What is claimed is:

1. A rotary switch comprising:

a. an electrically non-conductive core;

b. electrically non-conductive means, embedded in the core, for reinforcing the switch; and c. a plurality of electrically conductive segments spaced about the core, each segment having an anchoring system embedded in the core and formed about the reinforcing means to fasten the segment thereto.

2. A rotary switch according to claim 1 in which the anchoring system comprises:

a. means for supporting the reinforcing means; and b. means for maintaining the position of the reinforcing means during manufacturing and use.

3. A rotary switch according to claim 2 in which the supporting means comprises a ledge on which the reinforcing means rests and the position-maintaining means comprises a hook formed about the reinforcing means.

4. A rotary switch according to claim 3 in which the reinforcing means is a wound fiberglass ring.

5. A shell commutator comprising:

a. a core;

b. a reinforcing ring; and c. a strip of metal curled to form a cylinder having exterior and interior surfaces and slotted to form discrete segments, the interior surface of the strip contacting the core and comprising:

i. a ledge upon which the reinforcing ring rests; and ii. a hook formed about the reinforcing ring.

6. A shell commutator according to claim 5 in which the core is phenolic material, the reinforcing ring comprises wound fiberglass strands and epoxy resin, and the interior strip further comprises a second hook and first and second crowns embedded in the core.

7. A shell commutator comprising:

a. a phenolic core having inner and outer diameters;

b. a ring of wound fiberglass strands embedded in the phenolic core and having an outer diameter approximately equal to the outer diameter of the phenolic core; and c. a plurality of metal segments spaced about and contacting the outer diameter of the phenolic core, each segment comprising:

i. a tang; and ii. an anchoring system comprising:

A. an upper crown surrounded by the phenolic core;

B. an upper anchor formed into a hook about the ring and partially surrounded by the phenolic core;

C. a ledge for supporting the ring and partially surrounded by the phenolic core;

D. a lower anchor formed into a hook and surrounded by the phenolic core; and

E. a lower crown surrounded by the phenolic core.

8. A shell commutator according to claim 7 having a center of mass and in which the ring is positioned approximately thereat.

9. A shell commutator comprising:

a. a core of phenolic material;

b. a reinforcing ring comprising wound fiberglass strands and epoxy resin; and c. a strip of metal curled to form a cylinder having exterior and interior surfaces and slotted to form discrete segments, the interior surface of the strip contacting the core and comprising:

i. a ledge upon which the reinforcing ring rests;

ii. a first hook formed about the reinforcing ring;

iii. a second hook embedded in the core; and iv. first and second crowns embedded in the core.

10. A rotary switch comprising:

a. an electrically non-conductive core;

b. electrically non-conductive means, embedded in the core, for reinforcing the switch; and c. a plurality of electrically conductive segments spaced about the core, each segment having an anchoring system:

i. embedded in the core;

ii. formed about the reinforcing means; and iii. comprising a ledge on which the reinforcing means rests.

* * * * *